US011715896B2

(12) United States Patent
Wagner et al.

(10) Patent No.: US 11,715,896 B2
(45) Date of Patent: Aug. 1, 2023

(54) PRINTED CIRCUIT BOARD COAXIAL CONNECTOR

(71) Applicant: HUBER+SUHNER AG, Herisau (CH)

(72) Inventors: Martin Wagner, Steinach (CH); Franz Manser, Herisau (CH); Rudolf Hildebrand, Holzkirchen (DE); Michael Stuffer, Samerberg (DE)

(73) Assignee: HUBER+SUHNER AG, Herisau (CH)

( * ) Notice: Subject to any disclaimer, the term of this patent is extended or adjusted under 35 U.S.C. 154(b) by 160 days.

(21) Appl. No.: 17/289,633

(22) PCT Filed: Nov. 12, 2019

(86) PCT No.: PCT/EP2019/080975
§ 371 (c)(1),
(2) Date: Apr. 28, 2021

(87) PCT Pub. No.: WO2020/099375
PCT Pub. Date: May 22, 2020

(65) Prior Publication Data

US 2021/0399452 A1 Dec. 23, 2021

(30) Foreign Application Priority Data

Nov. 12, 2018 (CH) ..... 01389/18

(51) Int. Cl.
*H01R 12/00* (2006.01)
*H01R 12/91* (2011.01)
(Continued)

(52) U.S. Cl.
CPC ..... *H01R 12/91* (2013.01); *H01R 12/7082* (2013.01); *H01R 12/712* (2013.01);
(Continued)

(58) Field of Classification Search
CPC ... H01R 12/7082; H01R 12/716; H01R 12/73
See application file for complete search history.

(56) References Cited

U.S. PATENT DOCUMENTS 5,067,914 A * 11/1991 Seidel ..... H01R 13/6594 439/607.01
5,658,175 A * 8/1997 Muzslay ..... H01R 13/111 439/852
(Continued)

FOREIGN PATENT DOCUMENTS

CN 102576955 A 7/2012
CN 102714385 A 10/2012
(Continued)

OTHER PUBLICATIONS

EPO (Riswijk, NL), English language version of the International Search Report, Form PCT/ISA/210, for International Application PCT/EP2019/080973, dated Feb. 6, 2020 (03 pages).
(Continued)

*Primary Examiner* — Neil Abrams
(74) *Attorney, Agent, or Firm* — Pauley Erickson & Swanson

(57) ABSTRACT

A coaxial connecting member (1) for transmitting radio-frequency signals between a first and a second circuit board (2, 3) includes an inner conductor (4), an outer conductor (5) and an insulating member (6) arranged between the inner conductor (4) and the outer conductor (5). The inner conductor (4) and/or the outer conductor (5) comprise a first and a second end section (7, 8) to interconnect the inner conductor (4) to the first and the second circuit board (2, 3). The first and the second end section (7, 8) are interconnected to each other by at least one elastically deformable transversal section (9) to compensate axial and/or lateral misalignment of the first and the second circuit board (2, 3) with respect to each other.

19 Claims, 8 Drawing Sheets

(51) Int. Cl.

| | |
|---|---|
| ***H01R 12/70*** | (2011.01) |
| ***H01R 12/71*** | (2011.01) |
| ***H01R 13/24*** | (2006.01) |
| ***H01R 24/42*** | (2011.01) |
| *H01R 103/00* | (2006.01) |

(52) U.S. Cl.
CPC ..... *H01R 13/2428* (2013.01); *H01R 24/42* (2013.01); *H01R 2103/00* (2013.01)

(56) References Cited

U.S. PATENT DOCUMENTS

| | | | | |
|---|---|---|---|---|
| 5,791,911 | A | 8/1998 | Fasano et al. | |
| 5,820,390 | A | 10/1998 | Takamoto et al. | |
| 5,928,000 | A * | 7/1999 | Rudisill | H01R 24/52 439/700 |
| 6,231,352 | B1 * | 5/2001 | Gonzales | H01R 12/52 439/66 |
| 6,497,579 | B1 | 12/2002 | Garbini | |
| 6,951,482 | B1 | 10/2005 | Miller et al. | |
| 6,994,563 | B2 | 2/2006 | Amini et al. | |
| 7,393,214 | B2 * | 7/2008 | DiStefano | H01R 12/7082 439/74 |
| 7,491,069 | B1 * | 2/2009 | Di Stefano | G01R 1/07314 439/841 |
| 8,801,459 | B2 * | 8/2014 | Mrowka | H01R 24/50 439/246 |
| 9,281,641 | B2 * | 3/2016 | Baechle | H01R 24/50 |
| 9,300,063 | B2 * | 3/2016 | Tatzel | H01R 12/73 |
| 9,490,052 | B2 * | 11/2016 | Stein | H01R 24/38 |
| 9,589,710 | B2 * | 3/2017 | Stein | H01B 17/58 |
| RE46,958 | E | 7/2018 | Vinther et al. | |
| 10,249,968 | B2 * | 4/2019 | Dandl | H01R 12/716 |
| 10,483,669 | B2 * | 11/2019 | Petit | H01R 43/24 |
| 10,505,303 | B2 * | 12/2019 | Hoyack | H05K 1/111 |
| 10,790,604 | B2 * | 9/2020 | Song | H01R 12/714 |
| 11,387,611 | B2 * | 7/2022 | Smentek | H01R 12/91 |
| 11,411,347 | B2 * | 8/2022 | Wu | H01R 24/50 |
| 11,411,360 | B2 * | 8/2022 | Jung | H01R 24/50 |
| 2007/0190668 | A1 | 8/2007 | De Cloet et al. | |
| 2008/0085632 | A1 | 4/2008 | Benham | |
| 2011/0039448 | A1 | 2/2011 | Stein | |
| 2014/0004722 | A1 | 1/2014 | Stein | |
| 2014/0329421 | A1 | 11/2014 | Tatzel et al. | |
| 2015/0118899 | A1 | 4/2015 | Hügel et al. | |
| 2015/0118904 | A1 | 4/2015 | Baechie et al. | |
| 2021/0399452 | A1 | 12/2021 | Wagner et al. | |
| 2022/0368051 | A1 * | 11/2022 | Asano | H01R 24/50 |

FOREIGN PATENT DOCUMENTS

| | | | |
|---|---|---|---|
| CN | 202732640 | U | 2/2013 |
| CN | 107819262 | A | 3/2018 |
| CN | 108346874 | A | 7/2018 |
| CN | 108346876 | A | 7/2018 |
| DE | 102017002307 | A1 | 9/2018 |
| EP | 0 793 299 | A1 | 9/1997 |
| EP | 2 780 985 | A | 9/2014 |
| EP | 3 198 686 | A1 | 8/2017 |
| JP | H 02-98074 | A | 4/1990 |
| JP | 2010-050653 | A | 3/2010 |
| WO | WO 2017/059950 | A1 | 4/2017 |

OTHER PUBLICATIONS

Chinese Patent Office (CNIPO), Bejing, P.R. China, Office Action for Chinese Application No. 201980070568.1, dated Jul. 4, 2022 (13 pages).

EPO (Riswijk, NL), English language version of the International Search Report, Form PCT/ISA/210, for International Application PCT/EP2019/080975, dated Feb. 6, 2020 (3 pages).

* cited by examiner

PRINTED CIRCUIT BOARD COAXIAL CONNECTOR

CROSS REFERENCE TO RELATED APPLICATION

This application is a National Phase filing in the United States, under 35 USC § 371, of PCT International Patent Application PCT/EP2019/080975, filed on 12 Nov. 2019 which claims the priority of Swiss Patent Application CH 01389/18, filed 12 Nov. 2018.

These applications are hereby incorporated by reference herein in their entirety and is made a part hereof, including but not limited to those portions which specifically appear hereinafter.

BACKGROUND OF THE INVENTION

Field of the Invention

The present invention relates to a printed circuit board connector (PCB Connector).

Discussion of Related Art

EP 2780985B1, published in December 2016 and U.S. Pat. No. 9,300,063B2 published in March 2016, both in the name of Rosenberger Hochfrequenztechnik GmbH, are directed to a connector for the electrically conductive connection of two components. The coaxial connector is configured to connect two printed circuit boards for transmitting radio-frequency signals. It comprises a center conductor, an outer conductor and an insulating member arranged between the center conductor and the outer conductor. The outer conductor includes a first conductor having a tubular shell, which has at least one opening to reduce axial stiffness. The outer conductor includes a first conductor and a second conductor, which is likewise of a tubular form. The first conductor is in electrical conductive contact with the second conductor. The electrically conductive contact is also axially mobile in relation to a portion of the first conductor. The second conductor is solidly connected to the first conductor over a portion. The contact between the first and the second conductors is provided in particular in a portion of the first conductor in which the openings are introduced into the shell.

U.S. Pat. No. 7,491,069B1, published in February 2009, in the name of Centipede Systems Inc., is directed to a self-cleaning socket for contacting terminals on a microelectronic device. The first end of compliant tubular contactors rotate and wipe against terminals urged downwardly against the first end of the contactors. A rotational wipe of a contactor against a mating terminal breaks through any surface contamination layers on the terminal thereby producing good electrical contact. Rotation of the first end of a contactor is caused by a downward deflection of a collar supported by two or more helical legs along a midsection of the contactor. Deflection of the collar distorts the resilient helical legs, each of which exerts a force on the collar which add up to produce a torsional force on the collar, thereby providing a rotational wipe in response to a downward urging of a terminal against the contactor. A void along the axis of the tubular contactor provides a reservoir to hold debris dislodged from the terminal and to keep the debris from interfering with operation of the contactor.

CN 107819262, published in March 2018 in the name of Tyco Electronics Shanghai Co, is directed to a connector, which comprises a single integrated external terminal, a single integrated central terminal and an insulator. The single integrated central terminal is arranged in the external terminal. The insulator is arranged between the external terminal and the central terminal to isolate the external terminal from the central terminal. The external terminal is of an elastic structure, so that the external terminal is enabled to perform elastic deformation at least on the axial direction thereof. In addition, two end parts of the central terminal are respectively provided with at least one axial slot. The at least one axial slot divides the end part of the central terminal into multiple petals. Each end part of the central terminal is enabled to be an elastic finger with a multi-petal structure. The external terminal is integrated with the elastic structure, so that there is no need to provide additional springs for the external terminal.

CN 108346874A, published in July 2018 in the name of Tyco Electronics Shanghai Co., Ltd., provides an electrical connector, which includes a center contact assembly and a peripheral contact assembly. The peripheral contact assembly includes an inner peripheral guide torch body and an outer guide torch body. The inner guide torch body includes a first circuit board electrically connected to the first flange. Elastic pieces are configured to be resiliently deformable to achieve the outer guide torch body relative to the inner conductive barrels, a reciprocating motion.

CN 108346876, published in July 2018 in the name of Tyco Electronics Shanghai Co., Ltd., provides a connector which comprises an insulating body having a columnar body portion, a first terminal of the columnar body portion disposed within the insulator and a plurality of second terminals, circumferentially disposed on the insulator. The plurality of second terminals respectively have an elastic arm and are formed on a top end of said resilient arm, adapted to a first electrical contact with the electrical contacts of the circuit board. The plurality of second terminals are at the bottom end connected to a common cylindrical base.

SUMMARY OF THE INVENTION

The present invention is directed to a coaxial connecting member for transmitting radio-frequency signals between a first and a second printed circuit board spaced apart from each other. The coaxial connecting member comprises an inner conductor and an outer conductor and an insulating member arranged between the inner conductor and the outer conductor. For better performance, the inner and the outer conductor are arranged coaxially with respect to each other extending along a center axis. Depending on the design, the inner and/or the outer conductor can be designed deformable to a certain extend as described hereinafter in more detail. They may comprise a first and a second end section to interconnect the respective inner and/or outer conductor to the first and the second printed circuit board. The coaxial connecting member according to the invention can also be adopted to connect a coaxial cable to a printed circuit board, i.e., instead of connecting a first and a second printed circuit board to each other the coaxial connecting member can be interconnected at one end to a coaxial cable and on the opposite end to a circuit board.

Connectors known from the prior art for a similar purpose, are often based on spring loaded pin solutions for center contact in order to achieve an axial float characteristic. Furthermore, they often comprise a multipart outer conductor in order to achieve axial float characteristics and good RF screening. The mechanical spring characteristic, which is used for axial misalignment compensation, is separate from the electrical path of the connector, mainly because of undesirable electrical effects. The mechanical spring part and the electrical path comprise multiple elements with at least two parts and a sliding contact each for center and outer contact. This results in a complex and cost intensive design.

The invention allows combining the electrical path and the mechanical spring part for the inner and/or the outer conductor in a special manner. The advantages are a much simpler design, lower cost and the possibility to avoid moving and/or vibrating galvanic contacts as known from the prior art. If required, the connection member can be designed as a filter for specific frequencies as explained in more detail hereinafter. A coaxial connecting member according to the invention normally comprises an inner conductor and an outer conductor and an insulating member arranged between the inner conductor and the outer conductor. The inner conductor (center conductor) and the outer conductor are preferably arranged coaxial with respect to each other and held with respect to each other by the insulating member. Axial and transversal misalignment can be compensated by a specially designed inner conductor and/or an accordingly designed outer conductor (hereinafter usually called conductor when referred to at least one or both) not having any abrasion, wear off, etc. The inner and the outer conductor normally extend along a center axis. They normally comprise a first and a second end section to interconnect to a first, respectively a second circuit board. Depending on the field of application the inner and/or the outer conductor according to the invention can be combined with conventional inner, respectively outer conductors as known form the prior art.

The first and the second end section of the conductor preferably are interconnected to each other electrically and mechanically by at least one meander shaped grid section as described in more detail hereinafter, which, if required, can be designed as an elastically deformable spring section to compensate axial and/or lateral misalignment of the first and the second circuit board with respect to each other to certain extend. Alternatively, or in addition, they can be arranged non-deformable. Depending on the design, the meander shaped grid section, when viewing the connection member from the side, comprises at least two transversal sections interconnected to each other in the axial direction by at least one intermediate section. The intermediate section can be designed electrically passive or electrically active as such or in context with the neighboring elements and sections, taking frequency-dependent influence on the transmission behavior of the signal. The inner conductor can be in certain regions arranged at least partially displaceable with respect to the outer conductor. This can be achieved in that the inner conductor is arranged at least partially displaceable relative to the insulation member.

Preferably, the transversal sections are, when viewed from the side, with respect to the center axis of the coaxial connection member arranged essentially perpendicular to the center axis, preferably extending alternatively from the left to the right and in the following row from the right to the left and so forth. Good results, namely with respect to axial stability and transmission characteristics, can be achieved when the conductor according to the invention has a tubular shape. In this case, the transversal sections may have a ring shaped design as described hereinafter in context with the drawings. The conductor is preferably made from bent sheet metal in which the slots forming later the meander shaped grid structure are punched out. Alternatively, or in addition, the conductor can be made by turning and/or grinding, etc. Preferably, the bent sheet metal, in the longitudinal direction of the inner conductor, connects to each other along a joint. The joint can be established by a process out of the following group of processes: Laser welding, soldering. Good results can be achieved when the at least one conductor is made from copper alloys, e.g. CuBe, spring steel and if appropriate plated with one material out of the group of tin, silver, gold, etc.

The transversal sections and/or the intermediate sections of the conductor are preferably delimited from each other by at least one slot (recess). Good results can be achieved when the at least one slot is arranged essentially perpendicular with respect to the center axis. In the case, the conductor has a tubular shape, when looking at the conductor in a side view, the slots preferably extend across the whole cross-section of the conductor. If, for example, made from sheet metal, the slot can be made before bending of the sheet metal. Alternatively, or in addition, the slot can be made by recessing the inner connector by a tool from the side in the direction of the slot resulting in the meander structure. Depending on the design and the field of application, one or several slots can be arranged at an angle with respect to the center axis. Furthermore the at least one slot can have a curved, non-linear design taking influence on the deformation behavior during mechanical compensation and/or the frequency dependent electrical transmission properties. Under certain conditions, unwanted tilting effects can be compensated by other openings and/or thin places arranged accordingly. Good results can be achieved when the at least one transversal section is ring shaped and the ring sections are mainly charged with bending forces due to compression of the conductor in axial direction (direction of the center axis). The insulating member (insulator) encompassing the inner conductor can be foreseen to support the inner and/or the outer conductor in lateral direction during mechanical deformation. In the case of two or more transversal sections, the transversal sections can be interconnected to each other by a stay section, which is arranged between two transversal sections in a longitudinal and/or transversal manner. The stay section causes, that the transversal sections remain spaced a distance apart from each other. In a preferred variation, when looking in a side view, the conductor has a meander shape comprising a sequence of at least one transversal section with alternately arranged intermediate sections, transversal sections and if present at least one stay section. More than one transversal section can connect to a stay section and/or an intermediate section.

A conductor according to the invention preferably has a tubular design extending in the direction of a center axis. The conductor normally comprises a first and a second end section that are interconnected to each other by a pattern of transversal sections, stay sections and/or intermediate sections delimited from each other by slots forming a meander shaped grid section. The slots which, when looking at the conductor in a side view, may extend in viewing direction completely across the cross section, such that when looking at the conductor alone, it would be possible to look freely across the conductor despite the stay sections and/or the intermediate sections which interconnect the transversal sections in axial direction. The transversal sections normally extend from left to right and in the next row from right to left being part of the meander shaped structure. The transversal sections, respectively the slots of different rows can be arranged such that they overlap with respect to each other in axial direction. Alternatively, or in addition they can be arranged at the same position. Thereby the stay section would be in line with respect to each other.

If appropriate, the conductors can be designed, that the meander shaped grid section of the inner and/or the outer conductor in conjunction with the outer conductor (or vice versa) behave electrically like a planar microstrip line routed in meanders. In analogy, they correspond to two parallel micro strip lines with variable cross-sections and electrical coupled at specific points (see e.g. FIGS. 10 through FIG. 12). Such a structure has the effect of a high order low pass filter and requires special dimensioning (over the whole range of movement) to fit the electrical requirements and avoid unwanted damping at the frequencies to transmit which is one important aspect to be able to simplify design. The line width between the slots allow design of high impedance (small width) and low impedance (wide width) sections of the line. The overall impedance level could be lowered by reducing the distance between inner and outer conductor and filling it with a dielectric material with high permittivity. A spiral spring center contact would increase the impedance of this section and build a low pass filter with very low cut of frequency (some MHz) hindering RF-radio transmission.

Therefore, the inner and/or the outer conductor along with the insulating member arranged there between can be designed such that in combination they act as a high pass filter and/or a band pass filter. The at least one transversal section can be foreseen to compensate axial movement and tilting. The electrical path is preferably through the material of the inner conductor without additional sliding or other contact elements. If appropriate, the inner and/or the outer conductor can comprise at least one section made from insulating material, which is arranged in and interrupting the electrical path in a defined manner.

The design of the pattern of the slots, respectively the transversal sections allow to adjust spring characteristic in respect to force and deflection, e.g. spring force in the range of 0.5-5 N allows proper contact depending on the plating of the PCB and the connector. Depending on the design of the coaxial connection member, axial misalignments between two PCB boards of up to ±1.2 mm or more can be compensated.

The inner conductor may comprise at least one fastening means to fasten the inner conductor with respect to the insulating member. Good results can be achieved when the end sections, are ring shaped and comprise contact means in the form of contact notches protruding in the direction of the center axis, e.g. for even distribution of contact pressure. Alternatively, or in addition, the contact means can comprise one or several contact latches to establish contact to the related circuit board. The contact latches are preferably bent inwardly. If necessary, the contact pressure per unit area can be in the range of 5 N/mm2 or higher to assure good contact and to avoid micro-movements and fretting. If appropriate, at least one of the end sections can be foreseen to be attached to the related circuit board (or alternatively to a cable) in a rigid manner, e.g. by soldering. Combining two of the transversal sections with a ridged section in-between allows also compensation of axial misalignment between two contact points by bending. This allows compensating certain angle deviations between two printed circuit boards, e.g. 5°, and/or misalignment between the axes of upper and lower printed circuit board. The compensation values depend on the total length e.g. up to +/−1 mm with 20 mm distance between the two circuit boards.

By specific dimensioning of the herein described slotted structure, it is possible to obtain a high order low pass filter. It requires special dimensioning over the whole range of movement to fit the electrical requirements and avoid unwanted damping at the frequencies to transmit which is the key to be able to simplify the connector. The structure can also be designed to create specific high pass and/or low pass filtering and by this integrate the filter function in the connector without the need of additional components.

As mentioned above, the conductor can be designed so that the electrical behavior is frequency selective. The slots in the conductor, which are electrically high-impedance and thus behave inductively over a defined length, are interrupted by low-impedance sections (i.e. intermediate sections, resp. stay sections), which behave capacitively over a defined length. Depending on the dimensioning, low-pass filters with different frequency-selective properties can be obtained by a sequence of high-impedance and low-impedance sections of a micro-strip or coaxial line, such as Chebyshev, Bessel or Butterworth filters. If the DC pad of the inner conductor is interrupted by a capacitive coupling, bandpass filters can be produced with similar structures. The spring element can be used for an individual contact but also in an coaxial arrangement for one or both contact elements or multi contact.

Good results can be achieved when the insulating member is having a two-part design comprising a first and a second part, which can be inserted from both ends into the outer conductor and encompassing the inner conductor. The first and the second part can be designed such that they can snap together to be fixed inside the outer contact. The insulating member comprises an opening on the inside in which the inner conductor is arranged. The opening is shaped such that the inner conductor can deform as foreseen without hindering influence. Depending on the design, the insulator can also be one part and holding inner and outer contact by snap fit allowing axial and radial play.

Advantages of the coaxial connection member according to the invention are a more cost efficient and reliable solution of a planar contact to PCB compared to a spring loaded pin solution as known form the prior art.

The coaxial connection member can be arranged in an opening of an outer housing, which can be designed as an electrical shielding device.

A coaxial connection member can be used as single channel board-to-board connector and/or multi-channel board-to-board connector (e.g. 2×2) by having an additional housing out of plastic such or metal or a combination thereof. Depending on the field of application, only the center pin can be used in connection with an insulator. The outer contact can be incorporated as a shielding cover.

If appropriate especially the outer conductor as described above and hereinafter may comprise at least one shielding element which is preferably forming an integral part of the sheet metal which is used to form the outer conductor. Good results can be achieved when the shielding element is a strap-like flap which extends from the upper and/or the lower rim of the outer conductor and which is bent inwardly such that it extends essentially parallel to the grid section. Depending on the field of application, the shielding elements can be bent outwardly. A shielding element according to the invention is preferably arranged at a certain distance from a single or a group of slots of the grid section on the inside of the respective connector. It thereby reduces electromagnetic leakage which may occur across the slots. As the shielding element preferably forms an integral part of the sheet metal used to form the outer connector, it solves the problem of unwanted leakage but, in difference to the prior art which is based on two-part connector elements as described above, prevents the difficulties and extra expenses which result from the two part designs. The outer conductor comprising a shielding element still has a one-piece design for the outer conductor. The outer conductor which comprises a specific shielding element bent inwards in order to bypass the elastic slot elements. The inwardly bent elements make then a sliding contact to the actual body at the not slotted part (solid part). The electrical electromagnetic field runs therewith not over the elastic slots but rather over the inwardly bent shielding element. The shielding elements must be designed depending on the general design of the outer contact itself. Usually, the inwardly bent flaps should have the same size like the slotted outer structure itself and preferably completely cover them.

Good results can be achieved, when the at least the outer conductor has a polygonal cross-section, preferably trigonal, square or pentagonal cross-section. To achieve a good bypass each side edge of the polygon needs an inwardly bent shielding element. Depending on the number of corners of the outer conductor (polygon structure) as well as the type of inner conductor (round, flat, polygon, diameter) the inwardly bent shielding element must be designed accordingly. The polygonal cross section of the outer conductor preferably results from flat wall segments made from sheet metal which merge into each other by bends. At the first and/or the second end section strap-like shielding elements may extend from an end edge. They are bent inwardly and extend on the inside of the outer conductor above a thereto related grid section thereby reducing negative electromagnetic leakage from the outer conductor. The shielding elements usually comprise an inwardly bent lead-in which connects to the end edge of the outer conductor and which merges into a strap. The strap extends above the related grid section. At the end opposite to the lead-in, the strap may comprise a terminal section which is bent outwardly away from the center axis and which may form an electrical contact to the wall segment arranged underneath.

It is to be understood that both the foregoing general description and the following detailed description present embodiments, and are intended to provide an overview or framework for understanding the nature and character of the disclosure. The accompanying drawings are included to provide a further understanding, and are incorporated into and constitute a part of this specification. The drawings illustrate various embodiments, and together with the description serve to explain the principles and operation of the concepts disclosed.

BRIEF DESCRIPTION OF SEVERAL VIEWS OF THE DRAWINGS

The herein described invention will be more fully understood from the detailed description given herein below and the accompanying drawings, which should not be considered limiting to the invention described in the appended claims.

DETAILED DESCRIPTION OF THE INVENTION

Reference will now be made in detail to certain embodiments, examples of which are illustrated in the accompanying drawings, in which some, but not all features are shown. Indeed, embodiments disclosed herein may be embodied in many different forms and should not be construed as limited to the embodiments set forth herein; rather, these embodiments are provided so that this disclosure will satisfy applicable legal requirements. Whenever possible, like reference numbers will be used to refer to like components or parts.

Figure 1:
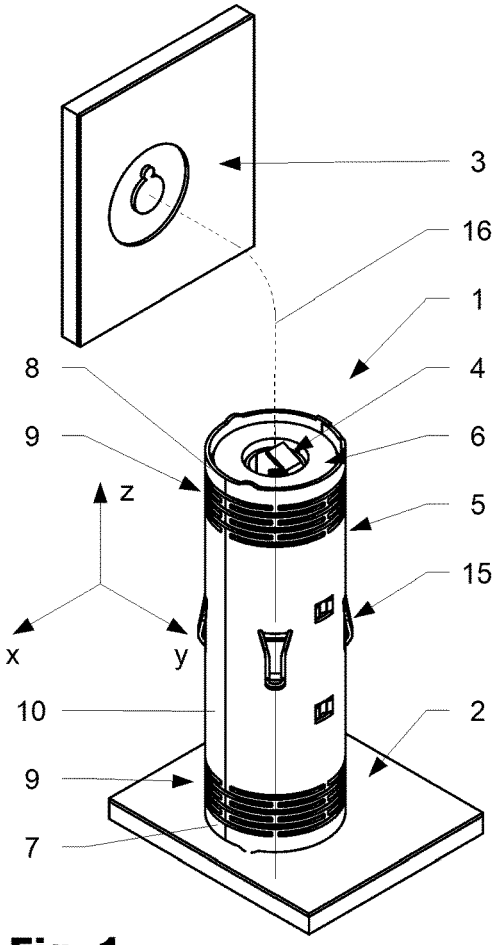
FIG. 1 shows a first variation of a coaxial connecting member according to the invention with a first and a second circuit board in a perspective view during mounting.

FIG. 1 illustrates a first variation of a coaxial connecting member 1 according to the invention, arranged between a first and a second circuit board 2, 3. In the final position, the first and the second circuit board are spaced apart from each other by a certain distance. In the shown drawing, the second circuit board 3 is shown in a detached manner. The direction of assembly is schematically indicated by a dotted line 16.

Figure 2:
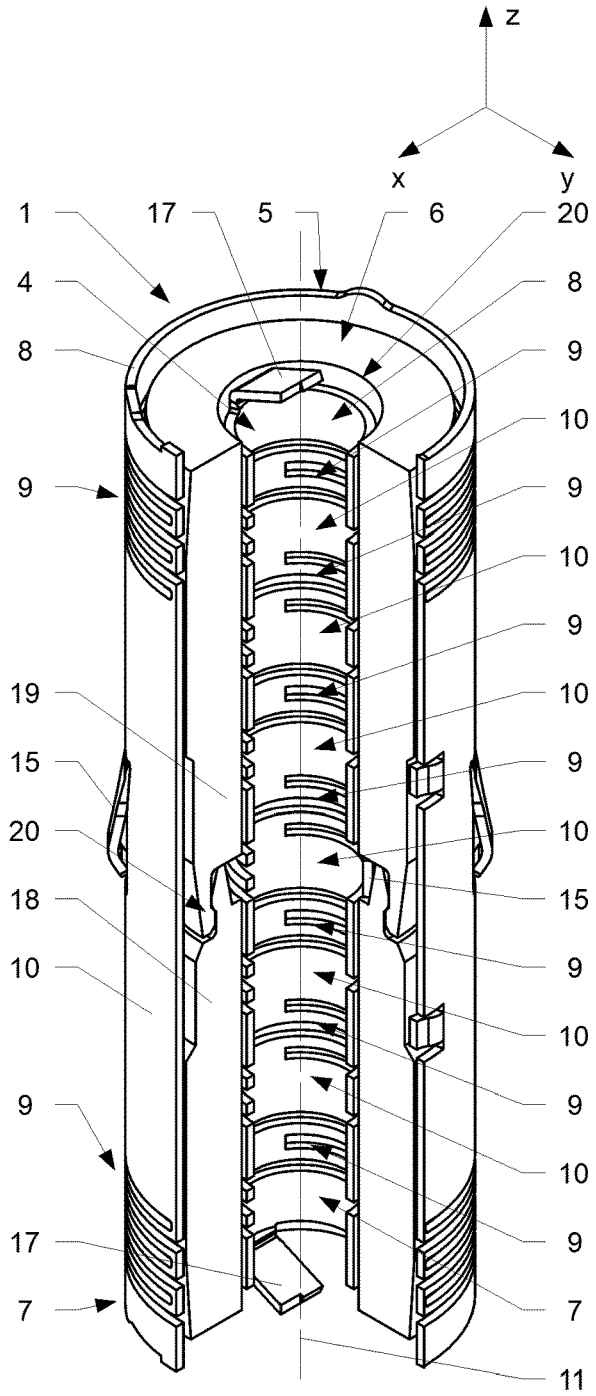
FIG. 2 shows the coaxial connecting member according to FIG. 1 in a perspective, partially cut view.

FIG. 2 illustrates the coaxial connecting member 1 in more detail in a perspective, partially sectionized view. The coaxial connecting member 1 comprises a tubular inner conductor 4 and a tubular outer conductor 5 arranged coaxially with respect to center axis 11. An insulating member 6 is arranged between the inner conductor 4 and the outer conductor 5. The inner conductor 4 further features at least one fastening means 15 to fasten the inner conductor 4 with respect to the insulating member 6, respectively to an outer housing. In the shown variation, the fastening means is a flap 15 turned out above the outer contour of the tubular inner conductor 4.

The insulating member 6 of the shown variation and as best visible in FIG. 2 has a two part-design comprising a first and a second part 18, 19, which during mounting are inserted into the outer conductor 5 encompassing the inner conductor 4. The first and the second part 18, 19 are interconnected to each other by a snap connection 20. The insulating member 6 comprises an opening 20 on the inside extending in axial direction in which the inner conductor 4 is arranged. The opening is shaped such that the inner conductor 4 can deform as foreseen without hindering influence. Depending on the design, the insulating member 4 can also be made in one piece.

The tubular shape of the inner conductor 4 is preferably made from bent sheet metal. The sheet metal connects to each other along a joint 13 (see FIG. 3) in the longitudinal direction (z-axis) of the inner conductor 4. However, depending on the field of application, other shapes of the inner conductor 4 are also possible, as explained based on selected embodiments (see FIGS. 6 and 7) in more detail below. The outer conductor 5 can have a similar design. Therefore, what is said with respect to the inner conductor 4 may apply accordingly to the outer conductor 5. At the end, the combination of the inner and the outer conductor 4, 5 and the insulating member 6 are important for the performance.

The inner conductor 4 comprises a first and a second end section 7, 8 to interconnect the inner conductor 4 to the first and the second circuit board 2, 3. For an even distribution of a contact pressure acting on the circuit boards and for electrical contact, the end sections 7, 8 each comprise a latch 17, which is bent inwardly extending to the center of the inner conductor 4. It establishes the contact to the boards 2, 3 along the centerline of the arrangement.

Figure 3:
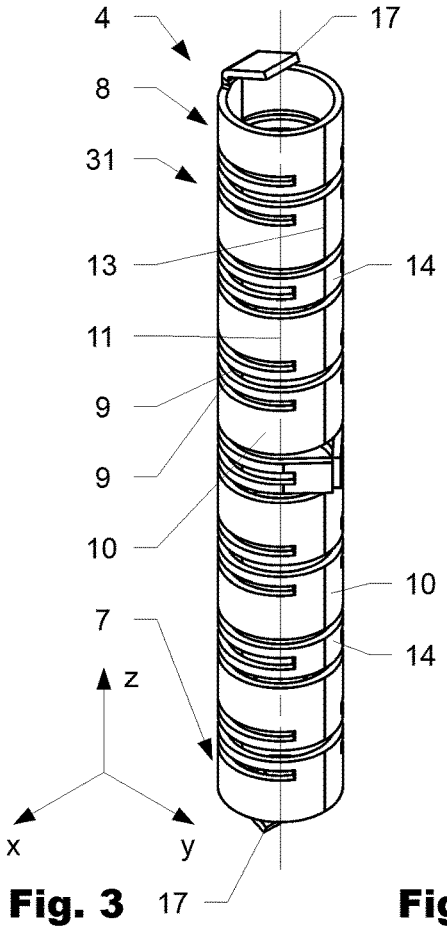
FIG. 3 shows an inner conductor of the coaxial connecting member according to FIG. 2 in a first perspective view.
Figure 4:
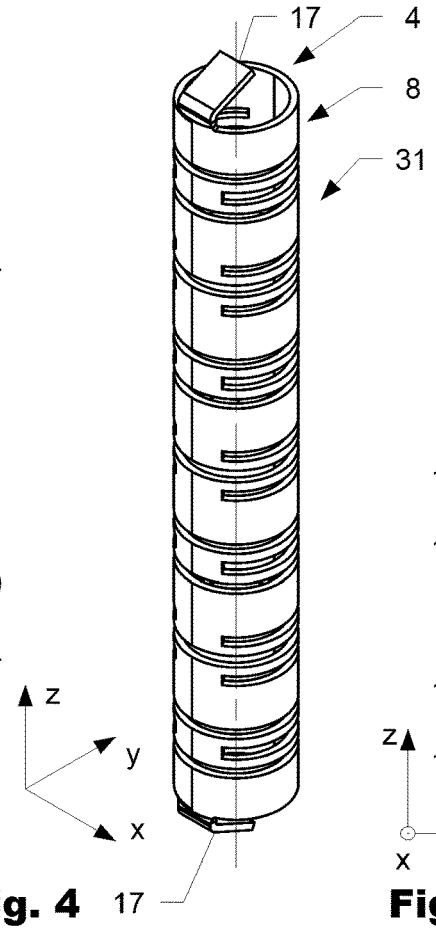
FIG. 4 shows the inner conductor according to FIG. 3 in a second perspective view.
Figure 5:
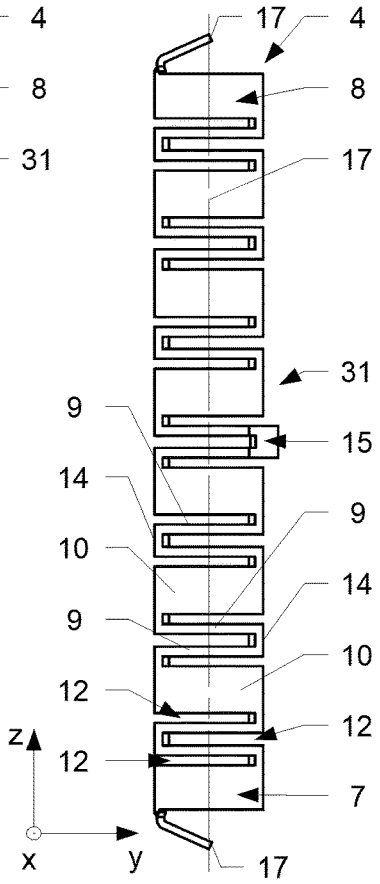
FIG. 5 shows the inner conductor according to FIG. 3 in a side view.

FIGS. 3 to 5 are showing the inner conductor 4 in more detail. As it can be seen best in FIG. 5, which shows the inner conductor 4 in a side view, the inner conductor has a meander shape, comprising a sequence of at least one transversal section 9 with alternately arranged intermediate sections 10, transversal sections 9 and stay sections 14 forming a meander shaped grid section 31 interconnecting the first and the second end sections 7, 8. Two transversal sections 9 are hereby interconnected to each other by at least one intermediate section 10 and delimited by slots 12, which are arranged between the transversal sections 9 and the intermediate sections 10. The slots 12 are arranged in general perpendicular with respect to the center axis 11. The intermediate sections 10 have a ring shaped cross-section, meanwhile the transversal sections 9 are ring shaped such that the ring sections are mainly charged with bending forces when the inner conductor 4 is compressed in axial direction. The stay sections 14 are arranged between two transversal sections 9, to space the sections a distance apart from each other. The first and the second end section 7, 8 are in the shown variation interconnected to each other by a section, which comprises a pattern of transversal sections 9, intermediate sections 10 and stay sections 14 which are delimited from each other by slots 12 forming a meander shaped grid section 31. The stay sections 14 are arranged alternately with respect to the center axis 11. Other variations are possible. The slots 12, which, when looking at the inner conductor 4 in a side view, may, as shown here, extend in viewing direction completely across the cross section. Therefore, when looking at the conductor alone, it would be possible to look freely across the slots 12 despite the stay sections 14 which interconnect the transversal sections 9 in axial direction.

As shown in FIG. 5, in a side view, the meander shaped grid section 31 typically form a meandering arrangement of transversal sections 9 and intermediate sections 10 in axial directions, with the transversal sections 9 and intermediate sections 10 generally extending parallel to each other. Between each two consecutive intermediate sections 10, two transversal sections 9 may be arranged in axial direction, with the transversal sections 9 being interconnected by a stay section 14 that generally extends in axial direction. A slot 12 that extends transverse to the axial direction may arranged between each two axially adjacent sections, thereby separating the sections. In the side view, each two slots 12 following each other axially can extend alternately from opposite sides transversely to the axial direction. The transversal sections 9 and the intermediate sections 10 may have different dimensions in the axial direction.

Figure 6:
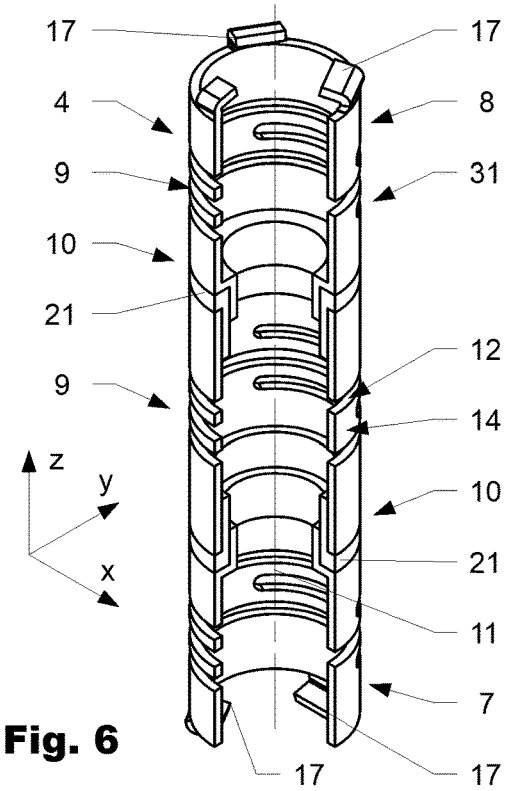
FIG. 6 shows a second variation of a coaxial connecting member according to the invention in a perspective, partially cut view.

FIG. 6 schematically illustrates a second variation of an inner conductor 4 for a coaxial connecting member 1 according to the invention. The inner conductor 4 is shown in a perspective, partially sectionized view. In addition to the previously discussed features, it comprises an intermediate section 10, with an insulating member 21, which is at least partially made from an insulting material and which is arranged in the electrical path of the signal to be transmitted. The combination causes that the inner conductor 4 acts as a filter for certain frequencies. Depending on the design a high pass filter, a low pass filter or a band pass filter results. The insulating members 21 are designed as sleeves, which are put together in axial direction with the adjacent elements. The insulating members 21 comprise on the inside a projecting edge 22 which extends into the adjacent intermediate section 10 and thereby centers the two elements with respect to each other. Depending on the design and the envisaged transmission behavior, an inverse arrangement can be foreseen.

Figure 7:
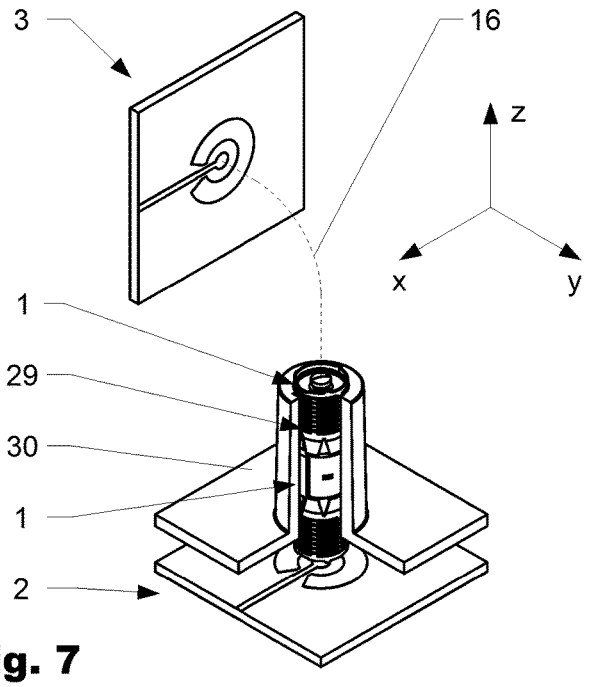
FIG. 7 shows a third variation of a coaxial connecting member according to the invention in a perspective, partially cut view.

FIG. 7 illustrates a third variation of a coaxial connecting member 1 according to the invention, arranged between a first and a second circuit board 2, 3. In the final position, the first and the second circuit board are spaced apart from each other by a certain distance. In the shown drawing, the second circuit board 3 is shown in a detached manner. The direction of assembly is schematically indicated by a dotted line 16. The coaxial connection member 1 can be arranged in an opening 29 of an outer housing 30. The outer housing 30 can be designed as an electrical shielding device.

Figure 8:
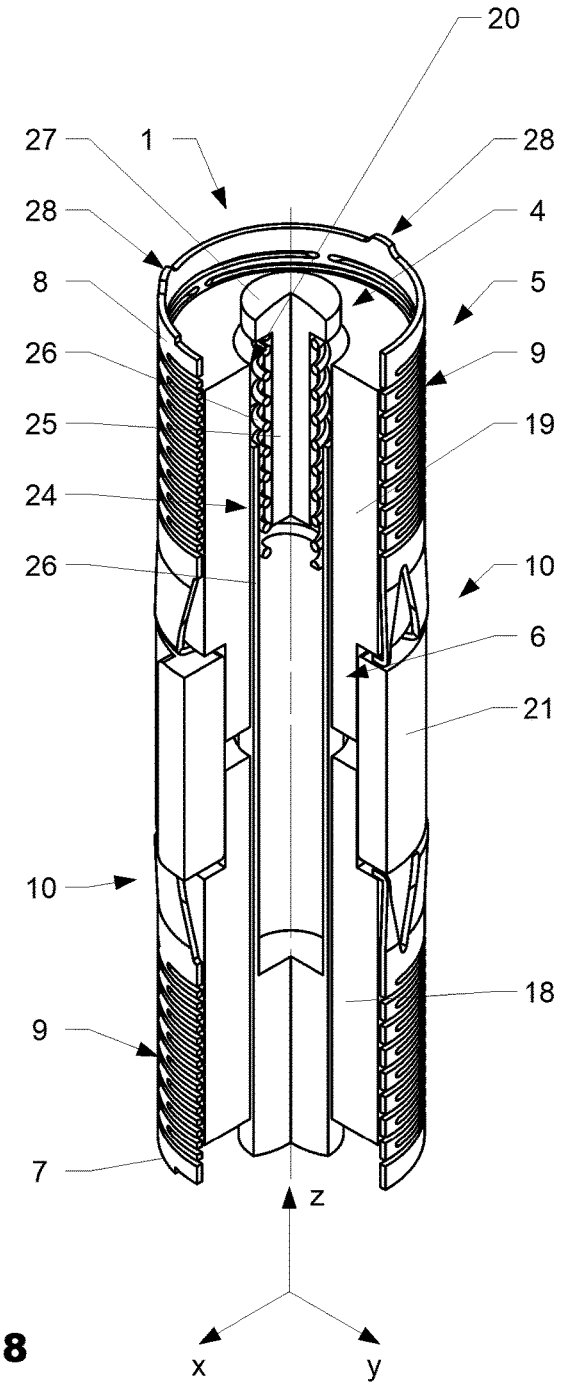
FIG. 8 shows details of the third variation according to FIG. 7 in a magnified manner and partially cut.

FIG. 8 illustrates the coaxial connecting member 1 according to FIG. 7 in more detail in a perspective, partially cutaway view. The coaxial connecting member 1 comprises a tubular outer conductor 5. The inner conductor 4 has a pin-like design and comprises a spring-loaded pin arrangement 24 with a contact pin 25, which is arranged axially displaceable in a sleeve 27 against the force of a spring 26. The spring-loaded pin arrangement 24 in an assembled position interacts with the first and the second printed circuit board 2, 3 as schematically indicated in FIG. 7.

An insulating member 6 consisting of multiple parts 18, 19, 21 is arranged between the inner conductor 4 and the outer conductor 5. The insulating member 6 has a two part-design comprising a first and a second part 18, 19, which encompass the inner conductor 4. The first and the second part 18, 19 are interconnected to each other by an additional insulating member 21, which is arranged, in the electrical path of the outer conductor 5 forming part of the intermediate section 10. The insulating member 6 comprises an opening 20 on the inside extending in axial direction in which the inner conductor 4 is arranged. The inner conductor 4 has a spherical end face 27, which allows tilting of the inner conductor in lateral direction.

The inner conductor 4 comprises a first and a second end section 7, 8 to interconnect the inner conductor 4 to the first and the second circuit board 2, 3. For an even distribution of a contact pressure acting on the circuit boards and for electrical contact, the end sections 7, 8 each comprise contact points 28 distributed along the circumference and which in axial direction (z-axis) protrude above an end surface of the respective end sections 7, 8. The contact points 28 are foreseen to establish contact with a related circuit board 2, 3. Other variations are possible.

Figure 9:
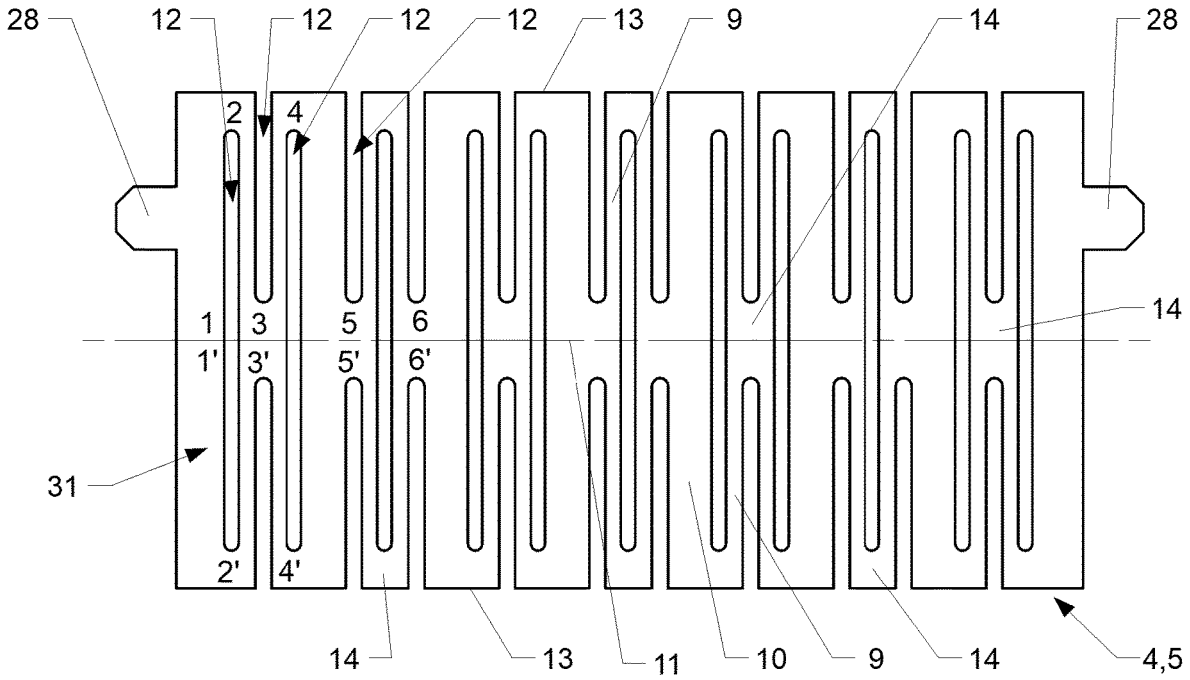
FIG. 9 shows an example of a conductor in an unwound manner.
Figure 10:
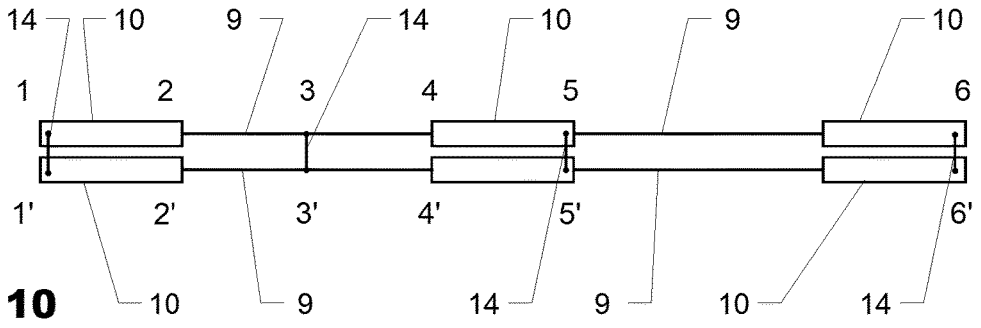
FIG. 10 shows two strip lines according to FIG. 9.

FIG. 9 schematically shows in an exemplary manner a conductor 4, 5 according to the invention in an unrolled state. The meander-shaped slotted structure of the conductor 4, 5 behaves in collaboration with the surrounding parts of the coaxial connection member 1 like a planar microstrip line routed in meanders. FIG. 10 schematically indicates the analogy to two parallel microstrip lines with variating cross-sections comprising thinner sections 9 and thicker sections 10 which are electrical coupled at specific points 14. When properly designed, this structure in combination with the surrounding elements, can have the effect of a high order low pass filter and requires special dimensioning (over the whole range of movement) to fit the electrical requirements and avoid unwanted damping at the frequencies to transmit which is an important aspect to be able to simplify the connector. The structure can also be designed to create specific high pass, all pass or low pass filtering and by this integrate the filter function in the connector without the need of additional parts.

Figure 11:
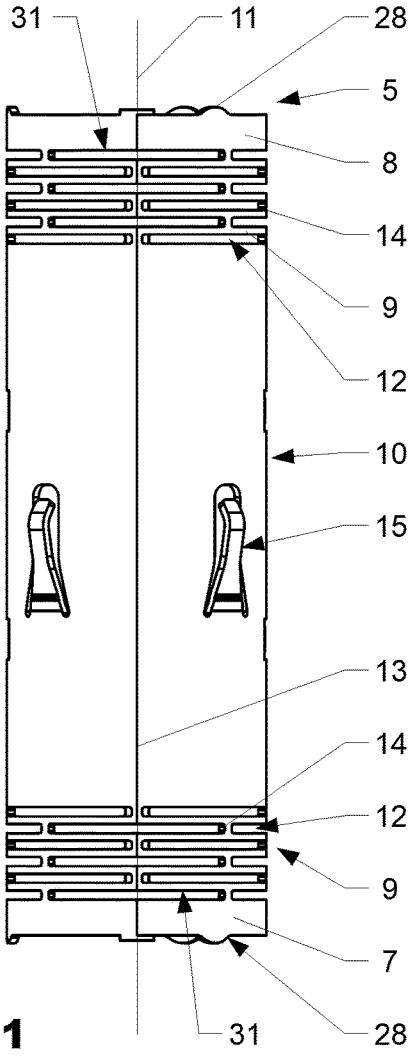
FIG. 11 shows a first example of conductor having a tubular design.
Figure 12:
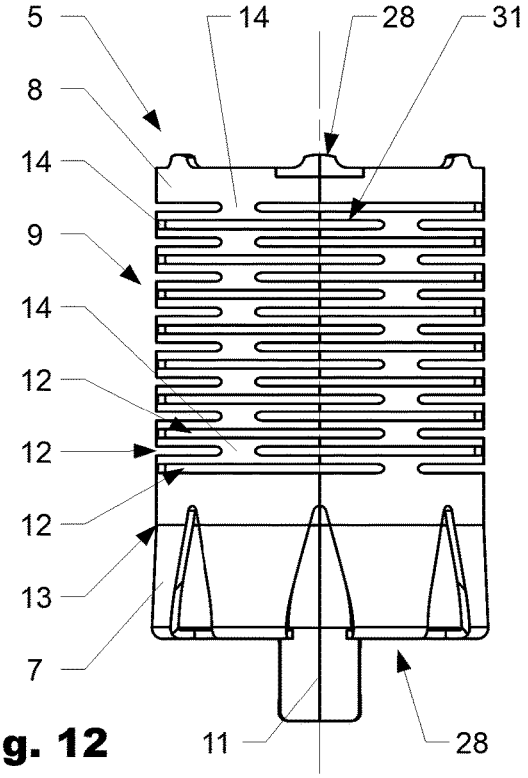
FIG. 12 shows a second example of a conductor having a tubular design.

FIGS. 11 and 12 are showing two samples of conductors 5, namely outer conductors 5 as shown in the variations of coaxial connection member 1 according to FIG. 1 (corresponding to FIG. 11) and FIG. 7 (corresponding to FIG. 12). The conductors 5 are having a tubular design extending in the direction of a center axis 11. They comprise a first and a second end section 7, 8 that are interconnected to each other by a pattern of transversal sections 9 and stay sections 12 delimited from each other by slots 12 forming a meander shaped grid section 31. The slots 12 which, when looking at the conductor in a side view, may, as shown here, extend completely across the cross section. Therefore, when looking at the conductor alone, it would be possible to look freely across the conductor 5 despite the stay sections 14 which interconnect the transversal sections 9 in axial direction. The conductors 5 are made from sheet metal. The pattern of the slots 12 are here punched out when the sheet metal is still in a flat state (see sample according to FIG. 9). Afterwards the sheet metal is bent to obtain the tubular structure. The sheet metal is interconnected along a joint 13.

Figure 13:
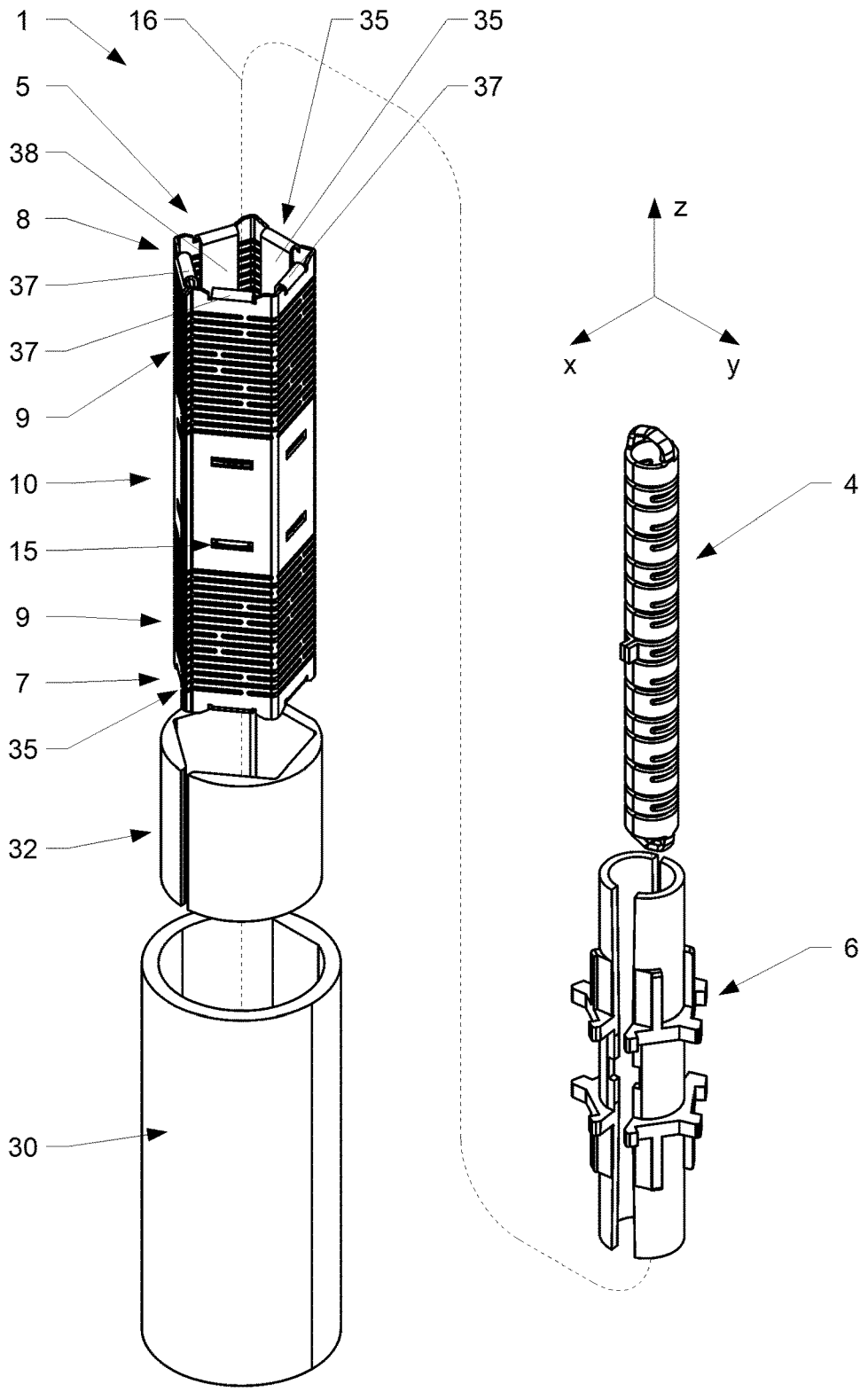
FIG. 13 shows an exploded view of fourth variation of a coaxial connecting member according to the invention.
Figure 14:
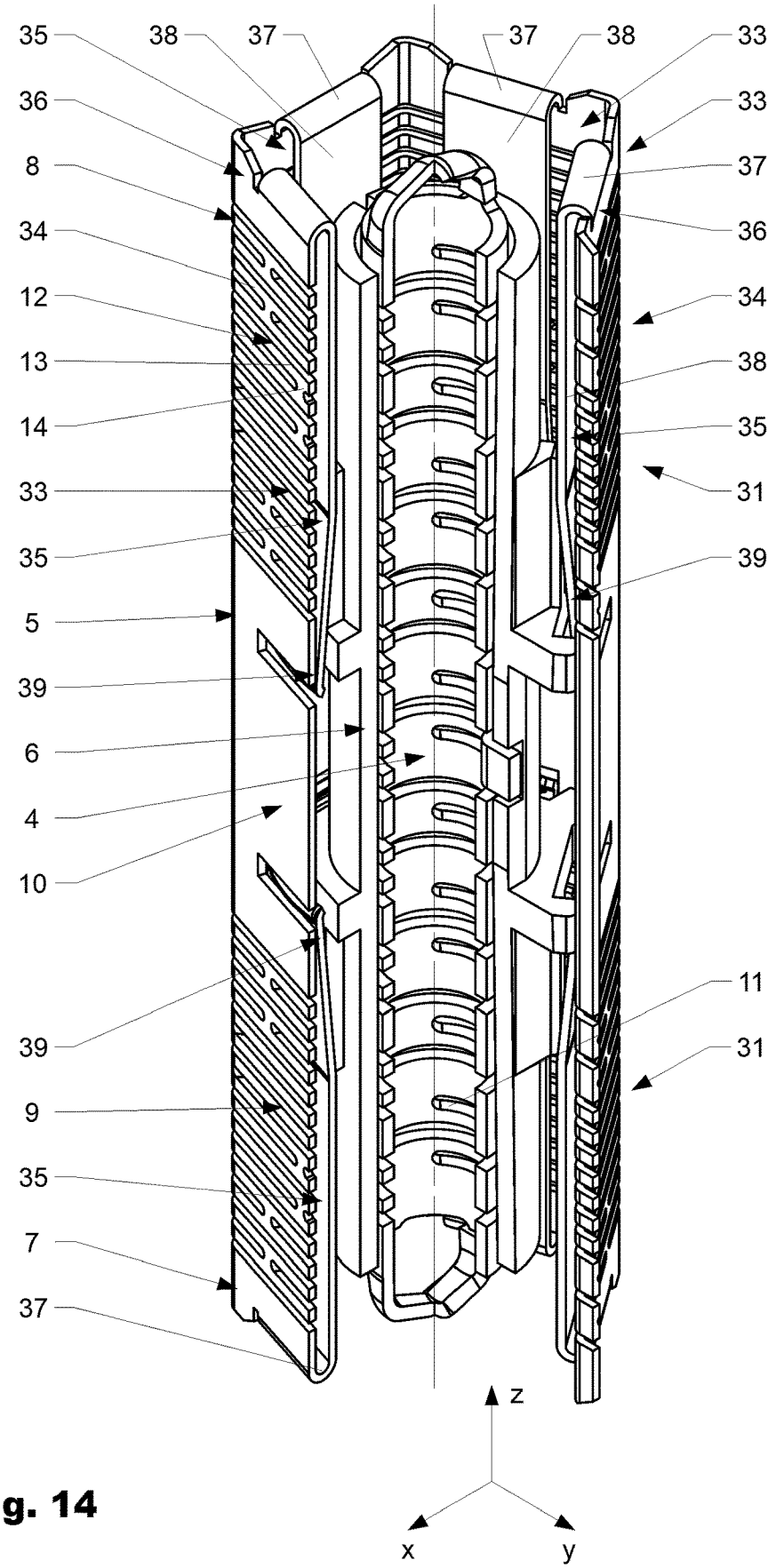
FIG. 14 shows a sectional view of the inner elements of the fourth variation according to FIG. 13.

FIG. 13 is showing a fourth variation of a coaxial connection member 1 in a disassembled manner. With respect to the general description reference is made to the specification above, such that only special aspects are described hereinafter. FIG. 14 is showing the fourth variation according to FIG. 13 without outer housing 30 and spacer 32 which in the assembled position is arranged between the outer conductor 5 and the housing 30. As best cut view according to FIG. 14, the outer conductor 5 is having a polygonal cross section with in the shown variation five corners 34. The polygonal cross section of the outer conductor 5 results from flat wall segments 33 made from sheet metal which merge into each other by bends 34. At the first and the second end sections 7, 8 strap-like shielding elements 35 extend from an end edge 36. They are bent inwardly and extend on the inside of the outer conductor above a thereto related grid section 31 thereby reducing negative electromagnetic leakage from the outer conductor. The shielding elements 35 usually comprise an inwardly bent lead-in 37 which connects to the end edge 36 of the outer conductor 5 and which merges into a strap 38. The strap 38 extends above the related grid section 31. At the end opposite to the lead-in 37, the strap 38 may comprise a terminal section 39 which is bent outwardly away from the center axis 11 and which may form an electrical contact to the (non-slotted) wall segment 33 arranged underneath. The insulating member 6 may be designed to interact in the mounted position with the shielding elements 35 from the inside. The insulating member 6 can press on the strap 38 and/or the terminal section 39 which is thereby actively pressed from the inside against the wall segment 33 arranged on the outside and thereby forming an electrical contact.

Figure 15:
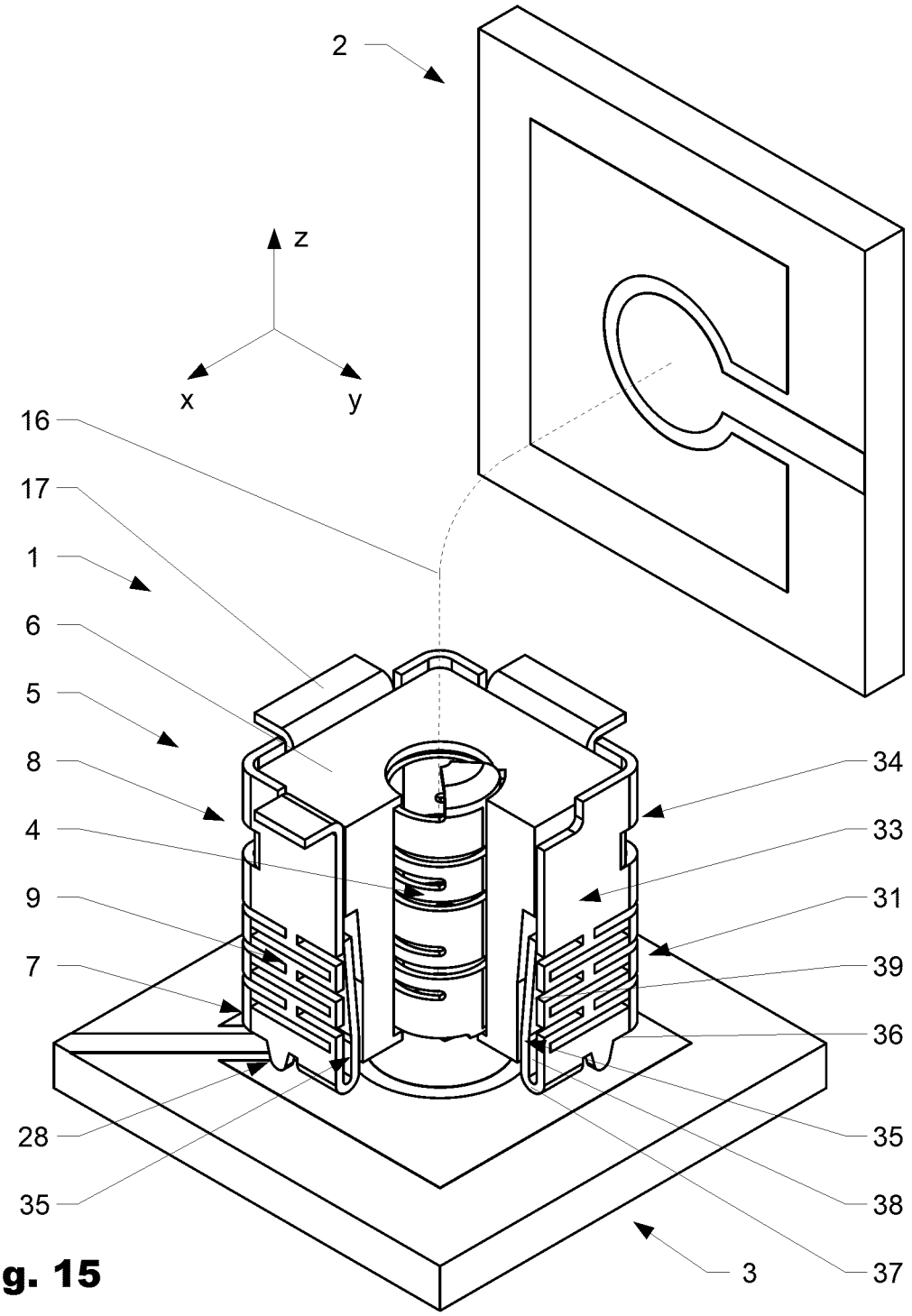
FIG. 15 shows a fifth variation of a coaxial connecting member according to the invention.

FIG. 15 is showing a fifth variation of a coaxial connection member 1 according to the invention between a first and a second circuit board 2, 3. With respect to the general description reference is made to the specification above, such that only special aspects are described hereinafter. The outer conductor 5 here comprises a square cross-section with four wall segments 33 which merge into each other by bends 34 each interconnecting two adjacent wall segments 33. The outer conductor comprises latches 17 which are here bent to the outward and which are foreseen to attach the outer conductor 5, respectively the coaxial connection member 1 to the first circuit board 2. Connection to the second circuit board is established by contact points 28.

The words used in the specification are words of description rather than limitation, and it is understood that various changes may be made without departing from the spirit and scope of the invention.

The invention claimed is:

1. A coaxial connecting member (1) for transmitting radio-frequency signals between a first and a second circuit board (2, 3) spaced a distance apart from each other, comprising:

a. an inner conductor (4) and an outer conductor (5) extending in a direction of a center axis (11) and an insulating member (6) arranged between the inner conductor (4) and the outer conductor (5), wherein the inner conductor (4) is made from bent sheet metal and wherein the bent sheet metal in a longitudinal direction of the inner conductor (4) connects to each other along a joint (13), b. wherein the inner conductor (4) and/or the outer conductor (5) comprise i. a first and a second end section (7, 8) to interconnect the inner conductor (4) and/or the outer conductor (5) to the first and the second circuit board (2, 3) and ii. wherein the first and the second end section (7, 8) are interconnected to each other by a pattern of transversal sections (9) and stay sections (14) which are delimited from each other by slots (12) forming a meander shaped grid section (31).

2. The coaxial connection member (1) according to claim 1, wherein the meander shaped grid section (31) is elastically deformable to compensate axial and/or lateral misalignment of the first and the second circuit board (2, 3) with respect to each other.

3. The coaxial connection member (1) according to claim 1, wherein the inner conductor (4) and/or the outer conductor (5) comprise at least two meander shaped grid sections (31) interconnected to each other by at least one intermediate section (10).

4. The coaxial connection member (1) according to claim 3, wherein at least one intermediate section (10) is at least partially made from isolating material (21).

5. The coaxial connection member (1) according to claim 3, wherein the transversal sections (9) with respect to the center axis (11) of the coaxial connection member (1) are arranged opposite to each other.

6. The coaxial connection member (1) according to claim 1, wherein the meander shaped grid section (31) is forming part of an electrical filter.

7. The coaxial connection member (1) according to claim 1, wherein the inner conductor (4) and/or the outer conductor (5) has a tubular shape.

8. The coaxial connection member (1) according to claim 1, wherein the inner conductor (4) and/or the outer conductor (5) are made from one piece of material.

9. The coaxial connection member (1) according to claim 1, wherein the sheet metal along the joint (13) is interconnected to each other by a process out of the following group of processes: laser welding, soldering.

10. The coaxial connection member (1) according to claim 1, wherein the transversal sections (9) and/or the intermediate sections (10) are delimited from each other by at least one slot (12).

11. The coaxial connection member (1) according to claim 10, wherein the at least one slot (12) is arranged generally perpendicular with respect to the center axis (11).

12. The coaxial connection member (1) according to claim 1, wherein at least one transversal section (9) is ring shaped.

13. The coaxial connection member (1) according to claim 1, wherein two transversal sections are interconnected to each other by a stay section (14).

14. The coaxial connection member (1) according to claim 1, wherein the at least one intermediate section (10) has a ring shaped cross-section.

15. The coaxial connection member (1) according to claim 1, wherein the inner and/or the outer conductor (4) comprises at least one fastening means (15) to fasten the inner and/or the outer conductor (4) with respect to an adjacent member (6).

16. The coaxial connection member (1) according to claim 1, wherein the first and/or the second end section (7, 8) comprises at least one connecting element (17) to interconnect the inner conductor (4) to a circuit board (2, 3) or a cable.

17. The coaxial connection member (1) according to claim 1, wherein the outer conductor (5) comprises at least one strap-like shielding element (35) extending from an end edge (36) of the outer conductor (5) at least partially above a thereto related grid section (31).

18. The coaxial connection member (1) according to claim 17, wherein the insulating member (6) interacts with the at least one shielding element (35) from inside thereby pressing the terminal section (39) of the at least one shielding element (35) against the wall segment (33) forming an electrical contact.

19. The coaxial connection member (1) according to claim 1, wherein the outer conductor (5) has a polygonal cross section.

* * * * *